US007534066B2

(12) United States Patent
Lolk et al.

(10) Patent No.: US 7,534,066 B2
(45) Date of Patent: May 19, 2009

(54) INTERLOCKING COUPLING SYSTEM FOR OVERHEAD ALIGNED RAILS

(75) Inventors: Søren Lolk, Hørning (DK); Henning B. Kristensen, Aarhus C (DK)

(73) Assignee: V. Guldmann A/S, Aarhus N (DK)

( * ) Notice: Subject to any disclaimer, the term of this patent is extended or adjusted under 35 U.S.C. 154(b) by 43 days.

(21) Appl. No.: 10/593,996

(22) PCT Filed: Feb. 22, 2005

(86) PCT No.: PCT/DK2005/000114

§ 371 (c)(1),
(2), (4) Date: Feb. 2, 2007

(87) PCT Pub. No.: WO2005/089691

PCT Pub. Date: Sep. 29, 2005

(65) Prior Publication Data

US 2008/0056815 A1 Mar. 6, 2008

(30) Foreign Application Priority Data

Mar. 24, 2004 (DK) ..... 2004 00474

(51) Int. Cl.
*F16B 21/02* (2006.01)

(52) U.S. Cl. ..... 403/330; 403/322.1; 403/325; 403/326; 403/300; 104/91

(58) Field of Classification Search ..... 403/300, 403/301, 319, 321, 322.1, 322.2, 322.4, 325, 403/326, 327, 330, 363; 5/85.1, 89.1; 104/91, 104/93, 94, 95
See application file for complete search history.

(56) References Cited

U.S. PATENT DOCUMENTS

| | | | | | |
|---|---|---|---|---|---|
| 3,345,471 | A * | 10/1967 | Kilburg | ..... | 104/93 |
| 3,540,153 | A * | 11/1970 | Aoki | ..... | 104/91 |
| 3,780,663 | A | 12/1973 | Pettit | | |
| 5,183,284 | A | 2/1993 | Paplinski | | |
| 5,405,080 | A * | 4/1995 | Yeung et al. | ..... | 238/10 F |
| 5,511,256 | A | 4/1996 | Capaldi | | |
| 6,125,765 | A | 10/2000 | Loomer | | |
| 6,439,955 | B1 * | 8/2002 | Feketo | ..... | 446/444 |

FOREIGN PATENT DOCUMENTS

| | | |
|---|---|---|
| DE | 20109626 | 11/2002 |
| JP | 11/60150 | 2/1999 |
| SE | 521554 | 11/2003 |

* cited by examiner

*Primary Examiner*—Michael P Ferguson
(74) *Attorney, Agent, or Firm*—James Creighton Wray

(57) ABSTRACT

The present invention relates to an interlocking coupling system (1) for overhead aligned rails (4, 5) of which at least one rail (4) is displaceably arranged and comprises a first coupling part (2) and a second coupling part (3), each of said coupling parts (2, 3) is arranged at end parts of said rails (4, 5) and arranged for interlocking, when said rails (4, 5) are in aligned position, wherein each of said coupling parts (2, 3) comprises a pivotal gate member (23, 33), and said first coupling part (23) comprises a locking bolt member (21) with a tapered end part (214) adapted to engage with a pin (334) projecting from said gate member (33) of said second coupling part (3) and said locking bolt member (21) is adapted to engage with a recess (234) in said pivotal gate member (23), and both said gate members (23, 33) are activated by displacing said locking bolt member (21).

8 Claims, 4 Drawing Sheets

INTERLOCKING COUPLING SYSTEM FOR OVERHEAD ALIGNED RAILS

This application claims the benefit of Danish Application No. PA 2004 00474 filed Mar. 24, 2004 and PCT/DK2005/000114 filed Feb. 22, 2005, which are hereby incorporated by reference in their entirety.

BACKGROUND OF THE INVENTION

The present invention relates to an interlocking coupling system for overhead aligned rails of which at least one rail is displaceably arranged and comprises a first coupling part and a second coupling part, each of said coupling parts is arranged at end parts of said rails and arranged for interlocking, when said rails are in aligned position.

For moving disabled persons from one position to another inside a room or between rooms, a sling mounted in an overhead rail system is used.

Inside the room the overhead rail system comprises side rails and a transverse rail, allowing full manoeuvring of the sling everywhere in the room.

When moving from one room to another, a coupling system is needed for the coupling of the end parts of two aligned rails. The coupling system provides a junction between the rail system in one room and the rail system in another room, which makes it possible to safely move the sling from one room to another.

It is equally vital that the coupling system provides end stops on the transverse rail, when the sling is moved around in one room, as well as a safe junction between two rail systems, when two end parts of rails are aligned.

In order to obtain a coupling system for both vital parts, the known coupling system comprises two coupling parts, where a first coupling part is mounted at the end part of a fixed rail in one room and a second coupling part is mounted at the end part of the transverse rail in another room.

When the sling is moved around in the room the second coupling part provides end stops on the transverse rail, rendering it impossible for the sling to slide out of the rail system, when the sling is positioned in outmost side positions near the end parts of the transverse rail.

When the sling is moved from room to room, the coupling system provides a safe junction by interlocking the first and second coupling parts. In this case it is of vital importance that the end parts of the rails are aligned as it allows the sling to be moved without running the risk of the sling sliding out of the first rail instead of into the second rail or sliding into a gap between the end parts of the rails rendering it impossible to move the sling forward or backward.

Thus it is important that the end parts of the rails are aligned horizontally and are maintained/locked in this position during the movement of the sling from the first rail system to the second rail system.

Furthermore it is important that the coupling system is provided with some kind of precautionary measures ensuring the coupling parts to interlock and maintain in locked position, or preventing them from being activated at all.

It is the object of the present invention to provide an interlocking coupling system for overhead aligned rails, which is mechanically simple and is provided with at least two levels of precautionary measures making said interlocking coupling system very safe to operate.

The object is obtained by an interlocking coupling system for overhead aligned rails, wherein each of said coupling parts (2,3) comprises a pivotal gate member (23,33), and said first coupling part (23) comprises a locking bolt member (21) with a tapered end part (214) adapted to engage with a pin (334) projecting from said gate member (33) of said second coupling part (3) and said locking bolt member (21) is adapted to engage with a recess (234) in said pivotal gate member (23), and both said gate members (23, 33) are activated by displacing said locking bolt member (21).

BRIEF SUMMARY OF THE INVENTION

In the present invention the coupling system comprises a first coupling part and a second coupling part, where said first coupling part is arranged at an end part of a first rail, and said second coupling part is arranged at an end part of a second rail and arranged for interlocking, when said rails are in aligned position.

Furthermore, said first coupling part provides an end stop on the first rail preventing the sling to slide out of the first rail, when the sling is moved around in a room by means of the overhead rail system, wherein said first rail is a transverse rail, and said second coupling part provides an end stop on the second rail preventing the sling from sliding out of the second rail, when said first and second rail are not aligned.

Preferably said second rail is either a fixed rail for moving the sling in a predetermined pattern into an adjacent room or a transverse rail of an overhead rail system in an adjacent room.

The interlocking coupling system of the present invention ensures safe movement of the sling between said rails at the junction of either a transverse rail to a fixed rail or a transverse rail to another transverse rail.

Said pivotal gate member has a bottom part which is formed to prevent any movement of the sling off the rail, but allowing any movement on the rail, thereby making it possible to mount a sling onto the rail.

In order to ensure interlocking of the coupling parts when said rails are aligned, said first coupling part comprises a locking bolt member with a tapered end part being adapted to engage with a pin projecting from said gate member of said second coupling part.

The rail is typically a rail with at least two through-going and longitudinal recesses arranged in an over and under position, a sling is moved through the bottom recess and the top recess is used either for attachment of fittings or for the parts of said first and second coupling parts.

In the present invention the locking bolt member of said first coupling parts is provided in the top recess of the second rail along with a tapered end part allowing easy displacement of said locking bolt in a longitudinal direction into the top recess of the first rail.

Said tapered end part of said locking bolt engages the top recess of the first rail and ensures that said two rails are aligned horizontally, even if said rails are slightly off alignment when said locking bolt is displaced.

Said locking bolt member with the tapered end part is adapted to engage with a pin projecting from a gate member of said second coupling part, when displaced opposite the first coupling part.

By engaging said pin projecting from gate member of said second coupling part by displacing said locking bolt member, said aligning members on said gate members engage with each other, whereby said two coupling parts interlock in two ways: by the engaging of said locking bolt member/pin and the engaging of said aligning members. Whereby a first level of precautionary measures is obtained.

To ensure a free passage of the sling through said coupling system, when said end parts of said rails are aligned and locked, said aligning member of said second coupling part is rigidly connected with said pivotal gate member, and said locking bolt member is provided with a projecting pin member adapted to engage with said pivotal gate member of said first coupling part, the said locking bolt being placed at a distance behind said tapered end part.

A displacement of said locking bolt causes both said pivotal gate members to swing from closed position into open position, because:

- said pin of said aligning member of said second coupling causes said aligning member and said pivotal gate member of said second coupling part to move pivotally, and
- said projecting pin member of said locking bolt member engages with said activation part and causes said pivotal gate member of said first coupling part to move pivotally.

To help said gate members return to closed position when said rail is not aligned, both said gate members are spring activated.

To obtain a second level of precautionary measures each of said coupling parts, furthermore, comprises a spring loaded key plate member with a number of ball bearings adapted to engage with said key plate member on the opposite coupling part.

The key plate member on the first coupling part will prevent the displacement of the locking bolt member, hence the opening of both gate members of the coupling system. The key plate member on the second coupling part will prevent the pivotal movement of the gate members of the second coupling part.

In a preferred embodiment of the present invention said first coupling part, said key plate member and said gate member are provided with elongated recesses for guiding said projecting pin member of said locking bolt member.

Said elongated recesses are arranged in such a manner that said projecting pin member of said locking bolt member engages with said first coupling part, said key plate member and said gate member at the same time.

Said second coupling part is provided with a locking arrangement for said key plate member and said gate member. Where said locking arrangement either connects the key plate member to the casing or the gate member to the casing. When the locking arrangement connects the key plate member to the casing, the gate member can not open and when said locking arrangement connects the gate member to the casing, the gate member can not close.

In a preferred embodiment of the present invention said locking arrangement comprises a locking ball adapted to move in a recess between said key plate member and said gate member.

The recesses of the key plate member and the casing are vertically aligned and in said casing recess a locking ball is positioned and said casing recess has a diameter which is lager than the outer dimension of said locking ball, allowing said locking ball to move freely through said casing recess.

The recess of the key plate member has a diameter which is smaller than the outer dimension of said locking ball, preventing said locking ball from sliding through said recess meaning that the key plate member is locked in a fixed position.

Equally the gate member is provided with a recess which has a diameter which is smaller than the outer dimension of said locking ball, preventing said locking ball from sliding through said recess and when the gate member is moved pivotally into open position the recess of the gate member will be aligned vertically to the recess in the casing and a part of the locking ball will protrude into the recess and thereby lock the gate member into a fixed position.

In order to lock said locking bolt and said pin projecting from said aligning member, said tapered end part of said locking bolt member is provided with an axially forwardly open recess for receiving said pin projecting from said aligning member of said second coupling part and said open recess having a transverse extension.

Since said aligning member moves pivotally, said pin projecting from said aligning member of said second coupling part is firstly fixed in said forwardly open recess and is consequently moved into said transverse extension of said open recess, thereby locking said locking bolt and said pin together preventing any retraction of said locking bolt member or sudden disengagement of said end parts of said rail.

As precautionary means each of said coupling part is provided with an aligning member being adapted to engage with an aligning member of said opposite coupling part, the interconnection of aligning members ensures that the rail will not move apart even if the locking bolt member is damaged or broken.

The user or an assistant must be able operate said coupling system from the sling or from a position on the ground, thus said first coupling part comprises means for displacement of said bolt member.

Said means for displacement of said bolt member could be one of the following:

- a manually operated mechanical device e.g. a pivotal bar arrangement with wires,
- an automatically operated mechanical device e.g. a displacement motor connected to said bolt member, or
- a combination of the aforementioned, where said manually operated mechanical device is a backup for said automatically operated mechanical device.

Said automatically operated mechanical device can be controlled e.g. by a remote control, or a control panel connected with cables and positioned in reachable distance of the sling.

BRIEF DESCRIPTION OF THE DRAWINGS

The invention will now be explained with reference to the accompanying drawing, wherein.

Figure 1:
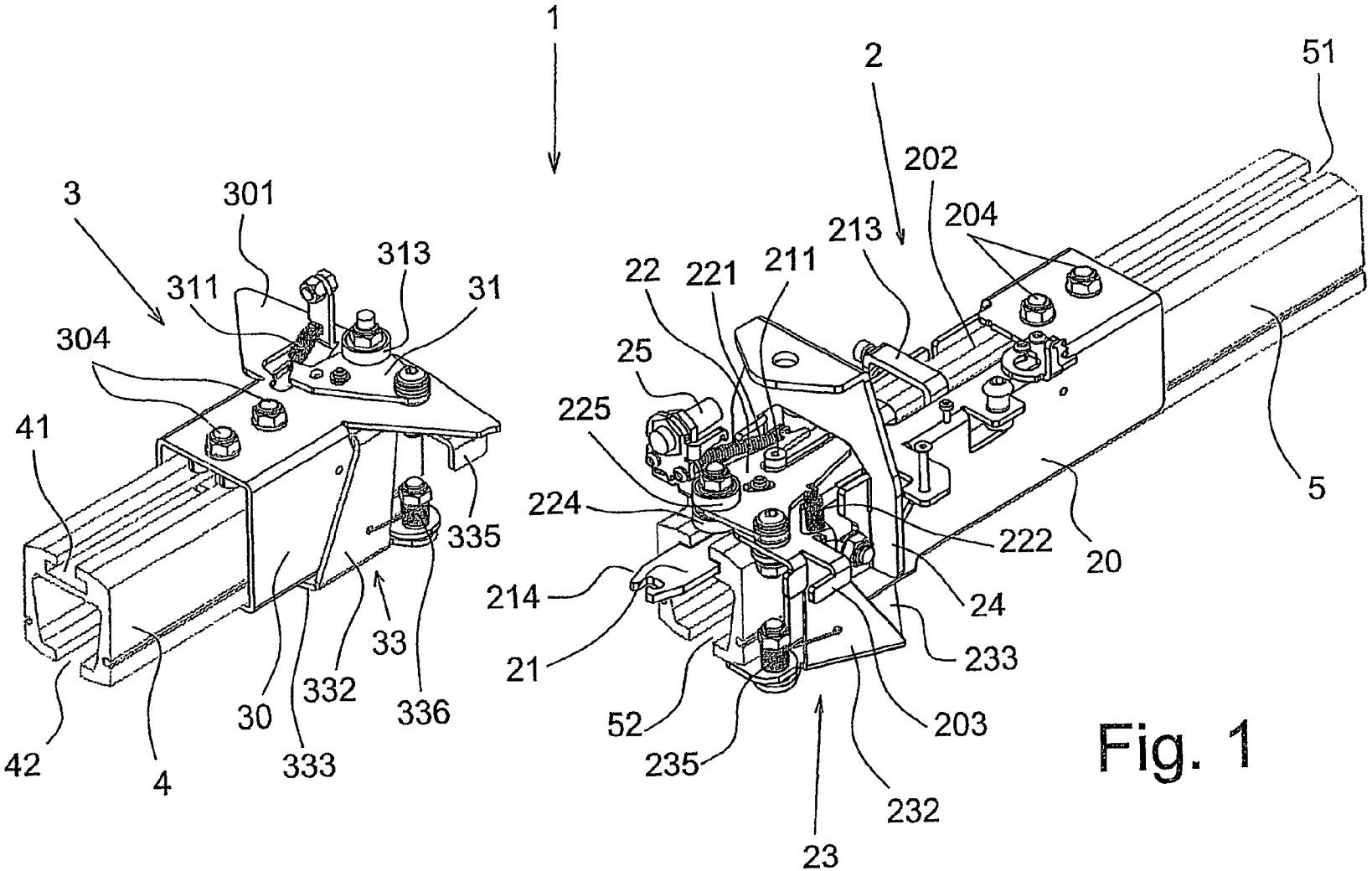
FIG. 1 is a perspective view of the coupling system according to the invention.

The reference numbers in the figures indicate the following:

1 Coupling system
2 First coupling part
20 Casing
201 Casing; elongated recess
202 Casing; side recess
203 Casing; aligning members
21 Locking bolt member
211 Locking bolt member; pin member
212 Locking bolt member; front bridge
213 Locking bolt member; back bridge
214 Locking bolt member; tapered end
215 Locking bolt member; forwardly open recess
216 Locking bolt member; transverse extension recess
22 Key plate member
221 Key plate member; spring
222 Key plate member; spring
223 Key plate member; recess

224 Key plate member; ball bearing
225 Key plate member; ball bearing
226 Key plate member; stop edge
23 Gate member
231 Gate member; top part
232 Gate member; side part
233 Gate member; bottom part
234 Gate member; top part; recess
235 Gate member; spring
24 Mounting holder
25 Sensor
3 Second coupling part
30 Casing
301 Casing; double wing part
302 Casing; double wing part; recess
303 Casing; recess
304 Casing; bolt
305 Casing; fitting
31 Key plate member
311 Key plate member; spring
312 Key plate member; recess
313 Key plate member; ball bearing
32 Locking ball
33 Gate member
331 Gate member; top part
332 Gate member; side part
333 Gate member; bottom part
334 Gate member; pin
335 Gate member; aligning member
336 Gate member; spring
4 Rail
41 Rail; top recess
42 Rail; bottom recess
5 Rail
51 Rail; top recess
52 Rail; bottom recess

DETAILED DESCRIPTION OF THE INVENTION

FIG. 1 shows a coupling system 1 comprising a first coupling part 2 and a second coupling part 3, where said first coupling part 2 is arranged at an end part of rail 5 and said second coupling part 3 is arranged at an end part of rail 4.

Mounting holders 24 connected to the casing 20 of said first coupling part is provided for the mounting of the rail 5 in a fixed position.

The casing 20 of said first coupling part 2 is fixed to said rail 5 with bolts 204, which are mounted onto a fitting (not shown) positioned in the top recess 51 of rail 5

The casing 20 furthermore comprises an aligning member 203 in the shape of two spaced protruding arm plates.

Said first coupling part 2 is shown with the gate member 23 in an open position and with the locking bolt member 21 positioned in said top recess 51 of rail 5, in a protruding position.

The key plate member 22 is arranged pivotally on the casing 20 and is spring loaded by means of two springs 221, 222 and provided with ball bearings 224, 225.

The pin member 211 of the locking bolt member 21 is shown guided in recesses (not shown) in said key plate member 22, said casing 20 and in the top part (not shown) of said gate member 23.

A sensor 25 is provided for detecting the alignment of said coupling parts 2, 3 arranged at end parts of said rails 4, 5.

The casing 30 of said second coupling part 3 is fixed to said rail 4 with bolts 304, which are mounted onto a fitting (not shown) positioned in the top recess 41 of rail 4.

The front part of said casing 30 is in the shape of a double wing part 301, the front edge being adapted for guiding said ball bearing 224 of said first coupling part 2 along the front edge into a front recess (not shown) when said rail 4 is positioned in front of said rail 5.

Said second coupling part 3 is shown with the gate member 33 in a closed position where the bottom part 333 prevents the sling (not shown) from being moved off said rail 4.

The key plate member 31 is pivotally arranged on the casing 30 and is spring loaded by means of one spring 311 and provided with a ball bearing 313, which is adapted to interconnect with ball bearing 225 of said first coupling part 2 when said rail 4 is positioned in front of said rail 5.

The key plate member 31 is provided with a recess 312 which is arranged for receiving a part of the locking ball (not shown) of the locking arrangement.

The gate member 33 furthermore comprises an aligning member 335 in the shape of a protruding arm plate, which is adapted to interlock between said two spaced protruding arm plates of said aligning member 203, thereby preventing said rail 4, 5 to move apart even if the locking bolt member 21 is damaged or broken.

The springs 235, 336 are arranged on said casings 20, 30 ensuring that said gate members 23, 33 is moved back into closed position, preventing a sling (not shown) to be moved off either said rail 4 or said rail 5 when said rail is not aligned and the locking bolt member 21 is pushed outwards in connection with the pivotal movement of said gate members 23, 33, due to the displacement of said locking bolt member 21.

It should be noted that the situation shown in FIG. 1 is only shown as an illustration of the possible position of said locking bolt member 21, as said locking bolt member 21, when said two rails 4, 5 are not aligned, is in a drawback position with said tapered end part 214 being positioned inside said top recess 51 of said rail 5 and with said back bridge 213 being moved back against said casing 20 in the side recess 202.

Figure 2:
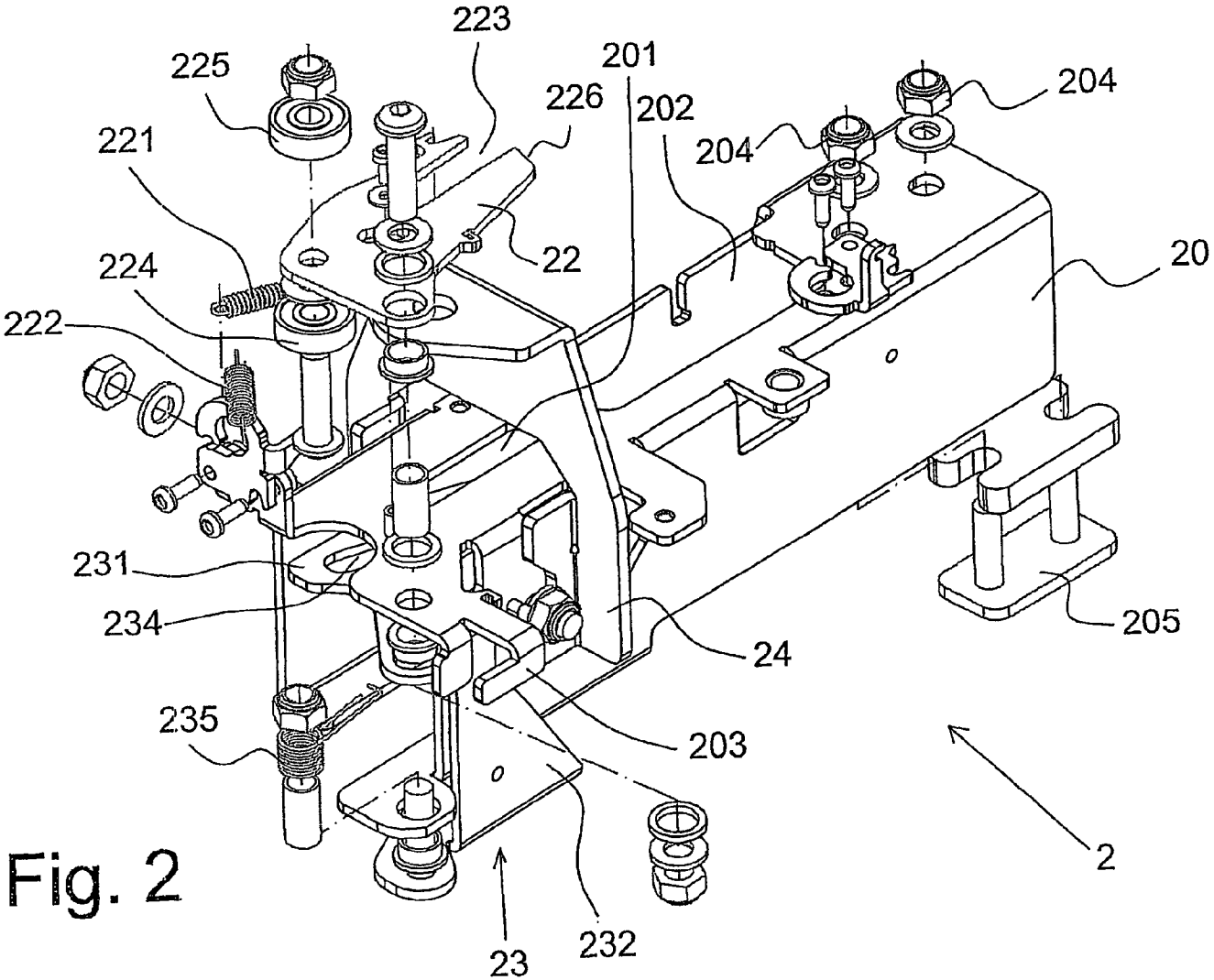
FIG. 2 is an exploded view of the first coupling part according to the invention.

FIG. 2 shows said first coupling part 2 in exploded view, and it is possible to see the recess 223 in key plate member 22, the recess 201 in casing 20 and the recess 231 in the top part 234 of gate member 23, wherein said pin (not shown) of said locking bolt member (not shown) is guided when a displacement of said locking bolt member (not shown) occurs.

As the spring 221 is connecting said key plate member 22 to said casing 20 and said key plate member 22 is pivotally arranged on said casing 20, said key plate member 22 will be forced to the side, whereby the stop edge 226 will prevent said pin (not shown) from sliding though recess 223.

When said ball bearing 224 is guided along said front edge (not shown) of said double wing part (not shown) of said second coupling part (not shown) and positioned into said front recess (not shown) of said double wing part (not shown) the pressure on said ball bearing 224 will force said key plate member 22 to rotate, whereby said stop edge 226 will be moved away and said pin (not shown) can slide though recess 223 and the underlying recesses 201,231 when a displacement of said locking pin (not shown) occurs.

The key plate member 22 is one of the precautionary measures for preventing the gate member 23 to open at random, because it will only allow a displacement of said locking bolt member (not shown), hence opening of gate member 23, when said rails (4,5) are aligned and the ball bearing 224 is positioned in said front recess (not shown) of said double wing part (not shown).

When said gate member 23 is in closed position said recess 234 in said top part 231 of said gate member 23 is arranged in a skew direction in comparison to the recess 201 of said casing 20. The forward push of said pin (not shown) of said locking bolt member (not shown) at recess 234, when a displacement of said locking bolt member (not shown) occurs will force said gate member 23 to move pivotally into an open position thereby allowing a passage through said rail (not shown).

The side recess 202 of said casing 20 is provided for allowing said bridges (not shown) of said locking bolt member (not shown) to slide back and forth.

Figure 3:
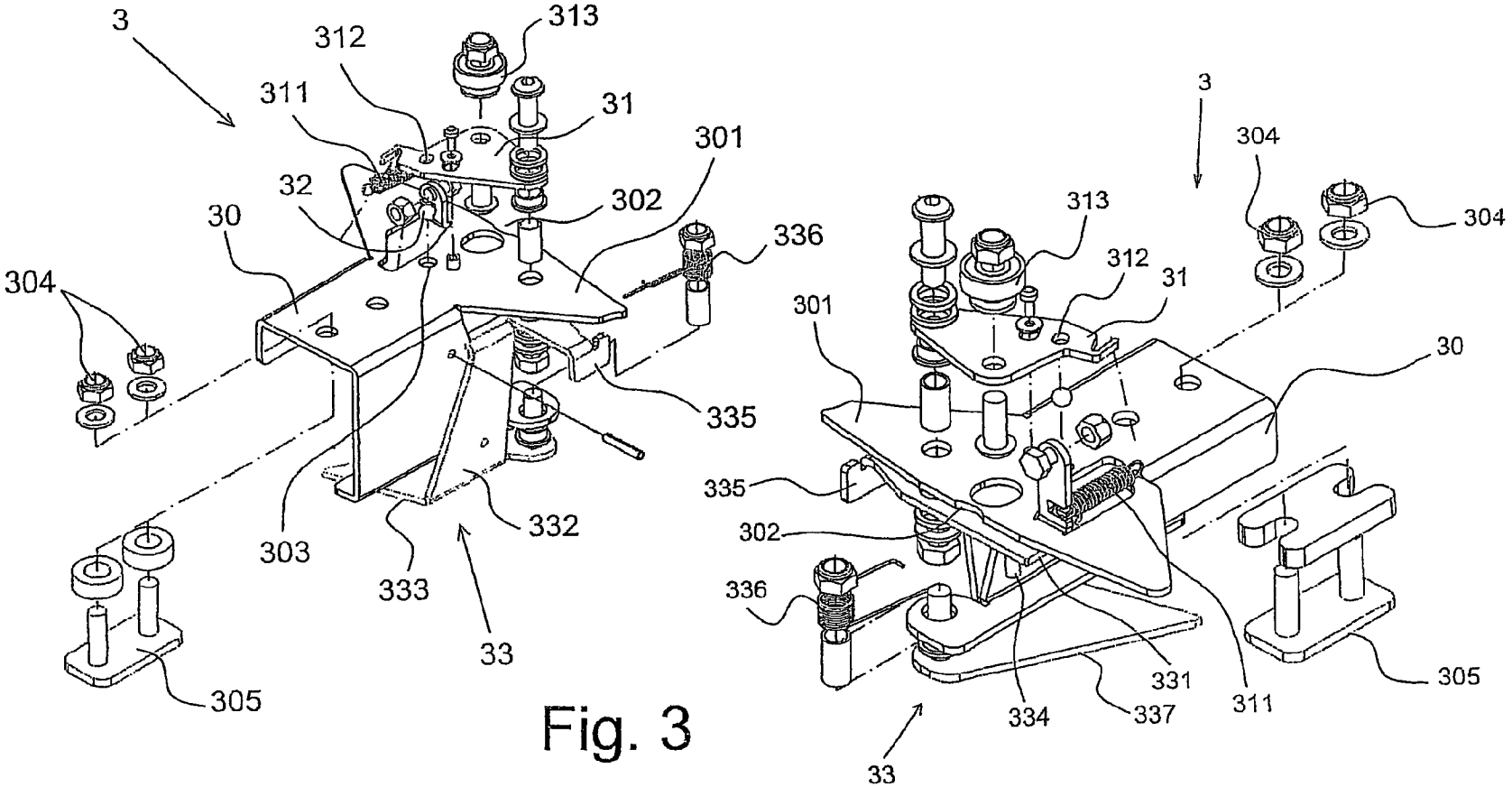
FIG. 3 is an exploded view of the second coupling part according to the invention.

FIG. 3 shows said second coupling part 3 in exploded view, in a rear view and a front view.

The gate member 33 is provided with a pin 334 which is adapted to interlock with the recesses (not shown) of said tapered end part (not shown) of said locking bolt member (not shown) when a displacement of said locking bolt member (not shown) occurs. Since said pin 334 is rigidly connected to said gate member 33 a displacement of said locking bolt member will (not shown) cause said gate member 33 to move into an open position.

As the spring 311 is connecting said key plate member 31 to said casing 30 and said key plate member 31 is pivotally arranged on said casing 30, said key plate member 31 will be forced into a first position.

Said casing 30 is provided with a recess 303, wherein a locking ball 32 is positioned, and said recess 303 has a diameter which is larger than the outer diameter of said locking ball 32, allowing said locking ball 32 to move freely through said recess 303. When said gate member 33 is in a closed position, said recess 303 will be positioned in alignment and above a recess (not shown) in said gate member 33, and said recess (not shown) in said gate member 33 has a diameter which is smaller than the outer diameter of said locking ball 32, preventing said locking ball 32 from sliding through said recess (not shown) in said gate member 33. A part of said locking ball 32 will protrude into said recess (not shown) in said gate member 33 and maintain said gate member 33 in a fixed position.

When said first coupling part (not shown) and said second coupling part 3 are aligned said ball bearing (not shown) on said first coupling part (not shown) will be positioned in contact and provide a pressure on said ball bearing 313, whereby said key plate member 31 is moved pivotally and the recess 312 will be positioned in alignment and above said recess (not shown) in gate member 33 and said recess 303 in said casing 30.

Said recess 312 has a diameter which is smaller than the outer diameter of said locking ball 32, preventing said locking ball 32 from sliding through said recess 312.

Due to the alignment of said recess 312, said recess 303 and said recess (not shown) in said gate member, it is possible to move said gate member 33 pivotally, because said locking ball is pushed up from the said recess (not shown) in said gate member 33 into recess 312, thereby locking said key plate member 31 in a fixed position and releasing said gate member 33.

The key plate member 31 is one of the precautionary measures for preventing said gate member 33 to open at random, only allowing an opening of said gate member 33, when the ball bearing 313 is activated by an opposite ball bearing (not shown) forcing said key plate member 31 into a pivotal movement, whereby said recess 312 is positioned in alignment and above recess 303, and the said locking ball 32 is pushed upwards due to the pivotal movement of said gate member 33.

The gate member 33 is provided with an aligning member 335 which is adapted to interlock with the aligning member (not shown) on the opposite coupling part (not shown).

Figure 4:
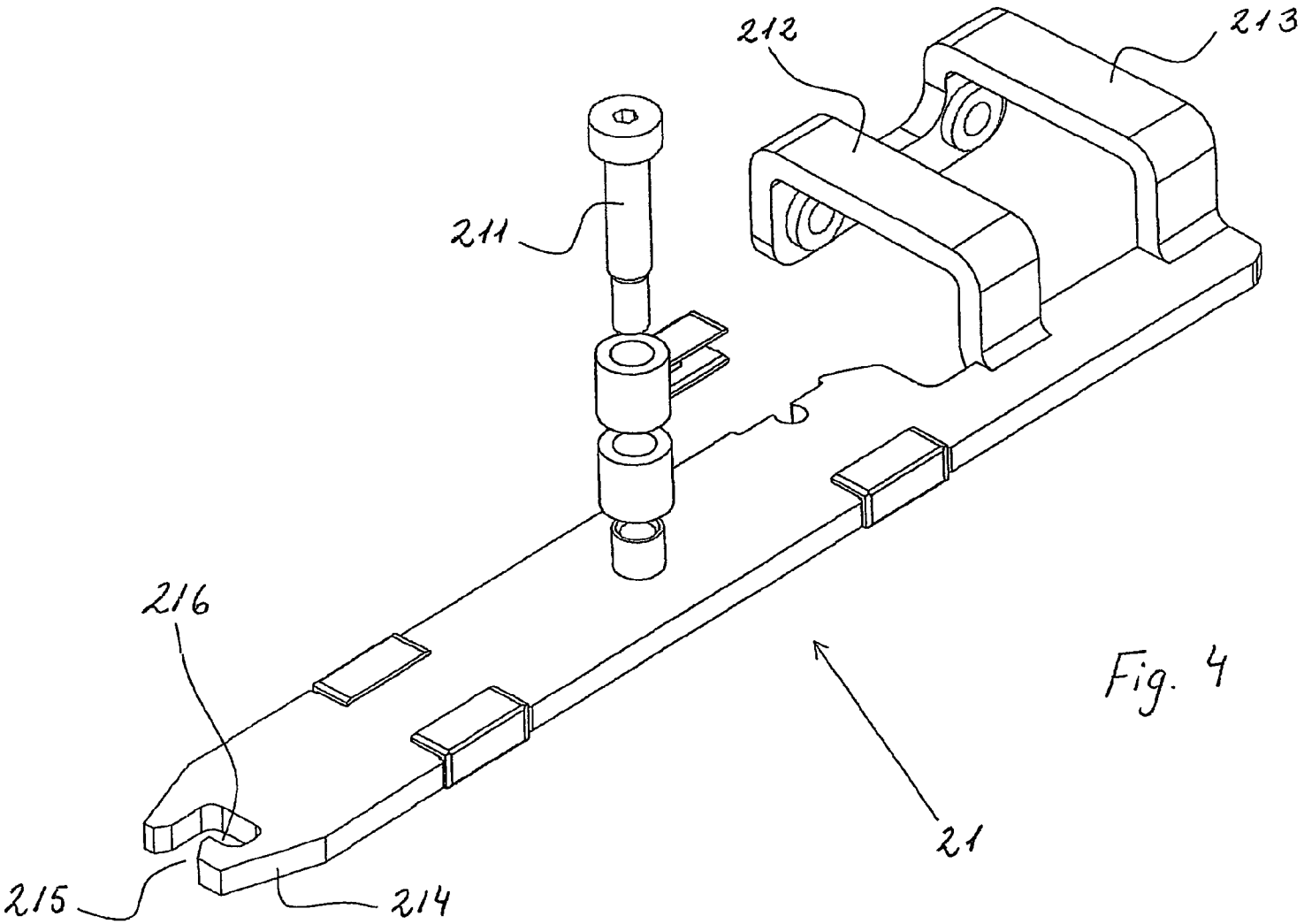
FIG. 4 is a view of the locking bolt according to the invention.

FIG. 4 shows locking bolt 21 with a tapered end part 214, which is provided with an axially forwardly open recess 215 for receiving the pin projecting (not shown) from said gate member (not shown) of said second coupling part (not shown), and said open recess 215 has a transverse extension 216 for locking said pin (not shown) preventing said locking bolt member 21 from being retracted while the gate members (not shown) are in an open position.

A projecting pin member 211 is adapted to engage to said pivotal gate member (not shown) of said first coupling part (not shown) is provided at a distance behind said tapered end part 214.

Bridge members 212, 213 are provided at opposite end of said recess 215, and adapted for engaging said side recess (not shown) in said casing (not shown) of said first coupling part (not shown). The distance between said bridge members 212, 213 allows for the arranging of means for displacement of said bolt member 21.

The invention claimed is:

1. Interlocking coupling system (1) for overhead aligned rails (4,5) of which at least one rail (4) is displaceably arranged, said coupling system comprising a first coupling part (2) and a second coupling part (3), each of said coupling parts (2,3) for arranging at an end part of a respective rail (4, 5) and arranged for interlocking when arranged on said rails (4, 5) in an aligned position, wherein each of said coupling parts (2, 3) comprises a pivotal gate member (23,33), and said first coupling part (23) comprises an axially protruding locking bolt member (21) with a tapered end part (214) comprising an axially forwardly open recess adapted to receive a pin (334) projecting from said gate member (33) of said second coupling part (3) when in said aligned position and an opposite end of said locking bolt member (21) is adapted to retractably engage with a recess (234) in said pivotal gate member (23) of said first coupling part, and when said coupling system is activated into a locked position both said gate members (23, 33) are activated to axially retract said locking bolt member (21) within said first coupling part gate member and lockably retain said pin within said recess in said locking bolt member, wherein each of said coupling, parts (2, 3), furthermore, comprises a pivotally mounted spring loaded key plate member (22, 31) with at least one ball bearing (224, 225, 313) adapted to engage with said key plate member (22, 31) on the opposite coupling part (2, 3) by pressing against the ball bearing on said opposite key palate member when the coupling parts are in said aligned position, thereby activating said key plate members from a spring loaded position, pivoting each key plate member into a locked position such that said first coupling part plate member pivots to axially retract the locking bolt member, locking said pin in said recess in said locking bolt member and locking the coupling parts together.

2. Coupling system (1) according to claim 1, characterized in that said locking bolt member (21), at a distance behind said tapered end part (214), is provided with a projecting pin member (211) adapted to engage with said recess in said pivotal gate member (23) of said first coupling part (2).

3. Coupling system (1) according to claim 2, characterized in that said first coupling part (2), said first coupling part plate member (22) and said first coupling part gate member (23) are provided with elongated recesses (223,234) for guiding said projecting pin member (211) of said locking bolt member (21).

4. Coupling system (1) according to claim 1, characterized in that said second coupling part (3) is provided with a locking arrangement for said second coupling part plate member (31) and said second coupling part gate member (33).

5. Coupling system (1) according to claim 4, characterized in that said locking arrangement comprises a locking ball (32)

adapted to move between a recess (312) in said second coupling part plate member (31) and said second coupling part gate member (33).

6. Coupling system (1) according to claim 1, characterized in that each of said coupling parts (2, 3) is provided with an aligning member (203, 335) being adapted to engage with an aligning member (203, 335) of said opposite coupling part (2, 3).

7. Coupling system (1) according to claim 1, characterized in that said open recess (215) has a transverse extension (216).

8. Coupling system (1) according to claim 1, characterized in that said first coupling part (2) comprises means for displacement of said locking bolt member (21).

* * * * *